United States Patent [19]

Duerr et al.

[11] 4,312,558

[45] Jan. 26, 1982

[54] FLUSH MOUNTED PLUG

[76] Inventors: Peter C. Duerr, 4757 W. 175th Pl., Country Club Hills, Ill. 60477; Claude De Facci, 22536 Lake Shore Dr., Richton Park, Ill. 60471

[21] Appl. No.: 130,585

[22] Filed: Mar. 17, 1980

Related U.S. Application Data

[63] Continuation of Ser. No. 961,515, Nov. 17, 1978, abandoned.

[51] Int. Cl.[3] ..... H01R 13/40

[52] U.S. Cl. ..... 339/130 R; 248/27.1; 285/161; 403/192; 403/238

[58] Field of Search ..... 339/127 R, 127 C, 130 C, 339/120, 125 R, 126 R, 119 R; 248/27.1, 27.3; 403/192, 194, 197, 238; 285/161, 206

[56] References Cited

U.S. PATENT DOCUMENTS

| | | | |
|---|---|---|---|
| 1,518,139 | 12/1924 | Freeman | 248/27.1 X |
| 3,534,321 | 10/1970 | Malachowski | 339/126 R X |
| 3,894,782 | 7/1975 | Hug | 339/130 C X |

*Primary Examiner*—Joseph H. McGlynn
*Assistant Examiner*—John S. Brown
*Attorney, Agent, or Firm*—Sixbey, Friedman & Leedom

[57] ABSTRACT

A heavy duty electrical power supply cabinet having a plug-in twist lock receptacle construction bodily supported against radial movement terminally at both of its ends for heavy duty use, and at a point intermediate its ends is rigidly supported against rotation and axial loosening by mating chordal flats that are spaced from the front wall of the cabinet in a rigidly mounted channel member as secured by a lock washer.

5 Claims, 6 Drawing Figures

FLUSH MOUNTED PLUG

Figure 1A:
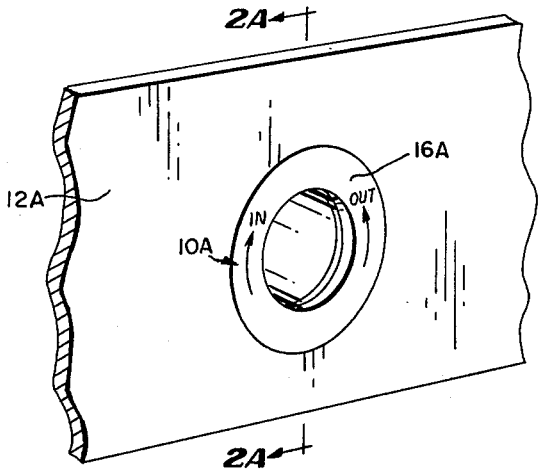

This is a continuation of application Ser. No. 961,515, filed Nov. 17, 1978 and now abandoned.

BACKGROUND OF THE INVENTION

Conventionally, in electric welding and other disconnectable uses of heavy plug-in extension cables for transmitting high amperage electrical currents, a cylindrical conductive female connector socket and a male twist lock plug-in are generally used.

A standard heavy duty plug-in socket unit for handling high amperage electrical currents has a molded insulating body having a coarsely threaded shank provided with external chordal faces and indexing tabs thereon non-rotatably engaging a front panel member having correspondingly shaped openings. A thick external cylindrical flange is provided around the socket opening at one end and engages the outside face of the panel from which it extends a substantial distance beyond the panel for strength and engagement against the outside face for securement by a lock washer threaded on the shank of the plug to clamp the flange and socket member tightly in place.

However, repeatedly used conventionally mounted plug-in sockets work loose and cannot be safely retightened without opening a cabinet where the heavy bus bars are located that carry different electric current potentials which are dangerous to personnel. Time and effort is required for safety sake to remedy such loosenings, and procrastination occurs.

More particularly, the cylindrical flange around the plug-in socket is subjected to the lateral and axial back and forth effort of a plugged-in flexible cable connector as a compounded loosening universal lever-like action along with the pull and twist movement of the plug in which the primary plug-in effort on the plug is expended inwardly on the socket in a direction that tends to relieve axial tension on the lock washer. This is followed by a rotational movement of the plug that urges the lock washer to rotate in a clockwise direction. Then when removing the plug, the lock washer is pulled tighter against the back side of the panel and any rotational component of movement is in the counter-clockwise direction of unthreading the tightly drawn lock washer, ever so slightly, each time.

Furthermore, the work strain upon a twist lock, plugged-in flexible cable, in use, also provides leverages against the exposed flange thickness of the plug which, over a period of time, gradually accelerates a loosening of the lock washer on the threaded shank which also in turn loosens progressively more rapidly. Also, although the back and forth use movement of the heavy plugged-in cables may loosen some of the most used sockets in a multi-outlet cabinet there may be no critical progressively loosening of other sockets receiving a lesser use of plug-in cables. However, a shut off and repair of the whole panel for the sake of safety to prevent possible shorts with bus bars is required to tighten any loose sockets even though only a few of several might be involved.

The use of a lock washer and a nut merely compounds the differential action among the parts if the bus bar connections also happen to serve as pivot points.

SUMMARY OF THE INVENTION

The present invention not only enables the use of lighter bus bars, with or without each bus bar serving significantly as a rigidifying element supporting the inner ends of the socket units, but it was found that the lock nuts do not loosen over long and hard periods of use where the conventionally exposed end surface of the socket flange is disposed substantially flush with the front panel within a clearance of only several thousandths of an inch all the way around the flange, and, for supporting the sockets, a lighter sheet metal spacer member is spot welded to the back of the panel a spaced distance therefrom to engage the back of the ring portion of the socket and hold the socket flush with the front face which in turn supports the socket against lateral movement along with the bus bar, thereby holding it against axial movement as well as radial movement.

OBJECTS OF THE INVENTION

Light metal spacer members spaced from the front panels are economically punched out with openings which non-rotatably engage and orient the chordal faces on the threaded shanks of the socket units to support them against any rotary movement when the nut locks are threaded and tightened in place. This firmly supports the socket against rotation and along with the bus bars provides axial support to a push-pull action that is non-yielding to any rotational forces on the socket including the threaded lock washer on the socket body, and the nut securing the socket in electrical contact with the bus bar.

Moreover, not only will the conventional anti-rotation structure be improved because of lightness of the spacer and mounting panel, but the ease and accuracy of punching a clean circular opening in an otherwise heavy panel member of the cabinet will be easier and closer tolerances and fits as well as better tool life is attained.

The anti-rotational elements can easily be provided in lighter metal parts for longer tool life in positioning and holding the plug flange concentrically in the panel opening and close clearances are attained that minimize lateral movement or any leverage action of a cable upon the socket body even when supported by a conventional locknut and anti-rotational assembly.

The support of the plug-in socket against rotation, once the lock nut is tightened into position, and the support of the socket element at both of its ends against lateral movement prevents any movement, in use, which would tend to loosen the socket from an enduring supported relationship. The lighter metal nut lock support is offset from the front panel and preferably spot welded to the front panel at least every other socket with the elements easily located for the cooperating openings to be in alignment.

IN THE DRAWINGS

Figure 1B:
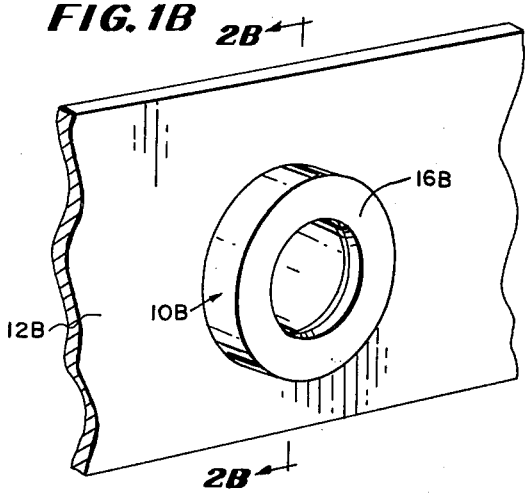
Figure 2B:
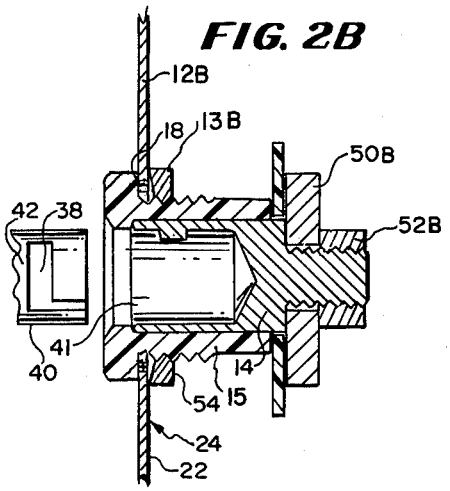
Figure 2A:
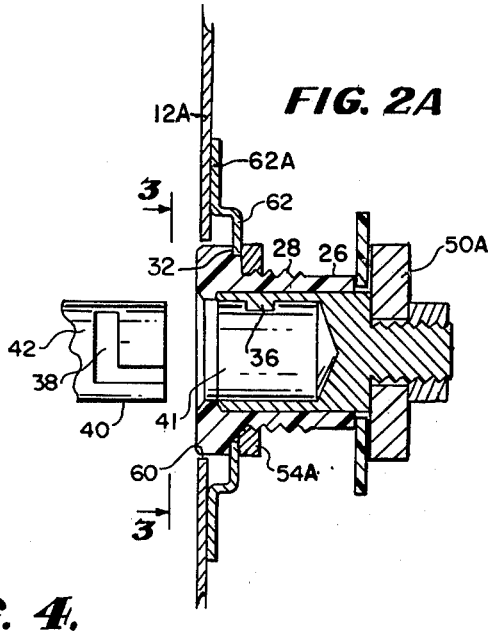
Figure 3:
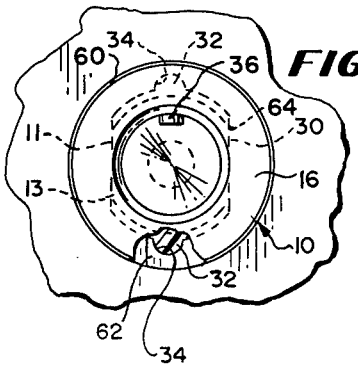
Figure 4:
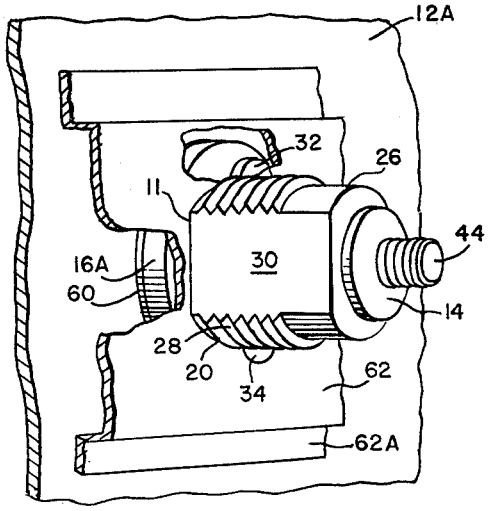

FIGS. 1A and 1B are perspective front view of comparison assemblies of the improved mounting and a prior art mounting, respectively, FIGS. 2A and 2B are longitudinal sections of FIGS. 1A and 1B respectively, including the relationship of the key pin and the lock groove of the twist lock connection carried by an extension cord and showing the attachment to the bus bar, and FIG. 3 is a front view of the socket partly cut away to illustrate offset lugs and, in broken lines, the coarse thread segments and chordal faces integrally molded in the back of the socket to support the socket against rotation, and FIG. 4 is a perspective rear view of the socket mounted in place on a cabinet panel, including cut-away sections illustrating both the positioning of the cylindrical flange between the back of the panel and the mounting bracket and the positioning of the offset lugs within the recesses formed in the mounting bracket.

DESCRIPTION OF THE INVENTION

Referring now to the drawings in further detail for a better understanding of the invention, the panel socket members 10A and B are shown for comparison as mounted in the conventional self-loosening mounting arrangement in prior art FIGS. 1B and 2B and the new and improved non-loosening mounting embodiment in FIG. 1A.

The conventional socket structure of FIGS. 1B and 2B includes a flange 16B formed on socket member 10B to conventionally overlap and rest against the front face of the front wall of a conventional cabinet panel 12B. Socket member 10B is clamped to panel 12B by a lock nut 54B and is additionally secured to bus bar 50B by a nut 52B which engages threads 46B formed on the socket member.

The preferred embodiment of the present invention is illustrated in FIGS. 1A, 2A, 3 and 4. Cylindrical flange 16A is formed at the front of socket member 10A and is mounted within a large circular opening 60 in panel 12A such that the radial clearance between the edge of circular opening 60 and cylindrical flange 16A is on the order of a few thousandths of an inch. Flange 16A is further supported for closely limited axial movement on a mounting bracket 62 secured by flanges 62A to the back of panel 12A in a manner which provides a flush fit between the front face of the cylindrical flange and the front face of the panel.

Socket member 10A is molded of an insulating material such as bakelite, and, as illustrated, has non-rotatively embedded therein a brass electrically conductive twistlock cylindrical contact member. Socket member 10A defines an internal flange 17 for rigidly supporting the brass contact member 14 under all strains in working position. If desired, flange 16A may be made axially much thinner to economize on axial spaces.

As illustrated in FIGS. 2A, 3 and 4, the shank 26 of the socket member 10A is cast with coarse thread segments 28 disposed between chordal faces 30 (FIG. 3). Chordal faces 30 mate with parallel chordal faces 11 in an otherwise circular opening 20 stamped in bracket 62 to receive threaded shank 26. Offset lugs 32 formed at the intersection of shank 26 and flange member 16A are present (FIG. 3) to engage recess 34 formed and at twelve and six o'clock in the stamped opening 20 for further support against relative rotation.

The brass contact member 14 may be either molded or made from bar stock and machined to provide a cylindrical socket 41 having a radially disposed internal key 36 coacting with an L-shaped groove 38 in the wall 40 of the mating cylindrical plug element 42 in which relative axial movement between the plug 42 and socket 41 enables a telescoping electrical contact of substantial extent between the two elements while a quarter turn of the plug locks the electrically contacting elements against inadvertant axial separation.

After the shank 26 is in place in opening 20, a lock nut 54A is threaded in place to clamp the flange 16A against the bracket 62.

The inner end 44 of the brass member 14 is of reduced size and threaded with a formed thread 46A to be received through a hole 48 and held by a threaded nut in electrical contact with a heavy electrical current carrying member which could be a copper connector or cable, but is shown and described as a bus bar 50A.

In the improved relation illustrated in FIGS. 2A and 3 the flange 16A is preferably flush with a circular hole 60 in the front wall with close clearance so that the radial forces upon the flange tending to move it radially will be constantly borne by the circular edge of the panel around the hole 60. The light weight bracket 62 is rigidly secured as by spot welding a front flange portion 62A to the back of the panel 12A with an offset portion thereof spaced from the back of the panel.

Thus, by neutralizing the radial working strains effective at the ends of a socket unit equipped to handle heavy electrical currents and dissipating them with minimum reaction between elements to well supported points provides a permanency of assembly and effective long period operation for a power distribution outlet cabinet and provides in the present invention not only longevity between servicing but also increases the safety of the personnel working with heavy currents of electricity.

Moreover, the body molded of insulating material is better protected from destructive radial and glancing blows, and the effects of any axial blows are greatly lessened by the flush mounting. Such will be received most of the time on the expanse of metal in the front panel where any loosening effect is substantially eliminated as already described. Moreover, the socket is supported over a larger area as well as on a plurality of different planes for superior mounting strength. Furthermore, with respect to cleanliness, a planar wipe-off surface is provided that has no protuberances present with conventional construction.

Also, it will be appreciated with the flush mounting a conventional snap cover (not shown) can be mounted on the front panel 12A to cover the outlet when not in use and thereby prevent dirt and dust collecting on the open sockets as well as inadvertant shocks to personnel.

What is claimed is:

1. A structure for mounting an electrical socket to receive the plug-in electrical connector of an electrical cable and for preventing relative movement of the electrical socket during use, the electrical socket including a flange portion with a first predetermined cross-sectional shape, a shank portion having a segment with a second non-circular predetermined cross-sectional shape extending from the rear surface of the flange portion, and an electrically conductive receptacle embedded in the shank portion to provide an electrical contact surface for the plug-in electrical connector, said structure comprising:

(a) a panel means for securing the electrical socket against lateral movement in a first plane, said panel means having a first opening formed therein to receive the flange portion of the electrical socket with minimal clearance, said panel means also having an edge defined by said first opening to support the flange portion of the electrical socket such that any lateral forces in said first plane tending to move the electrical socket laterally bear instead against said edge in a manner which prevents lateral movement of the electrical socket, said first opening having a contour corresponding to the first predetermined cross-sectional shape, and;

(b) a bracket means attached to the rear surface of said panel means for securing the electrical socket against lateral movement in a second plane parallel to said first plane, against axial movement in a third plane perpendicular to both said first and second planes and against rotation about an axis perpendicular to both said first and second planes, said bracket means including a first bracket portion having a first surface which supports the rear surface of the electrical socket flange portion when said first opening receives the flange portion, said first bracket portion also having a second opening formed therein to receive the electrical socket shank portion when said first opening receives the flange portion, said second opening having a contour corresponding to the second, non-circular predetermined cross-sectional shape, said bracket means also including a second bracket portion connecting said first bracket portion in spaced relationship to the rear surface of said panel means such that the front surface of the electrical socket flange portion is flush with the front surface of said panel means when the rear surface of the flange portion is supported by said front surface of said first bracket portion.

2. A structure as set forth in claim 1, wherein at least one lug is formed on the rear surface of the electrical socket flange portion and said contour of said second opening includes a cut-out for receiving the lug.

3. A structure as set forth in claim 1, wherein the segment of the electrical socket shank portion having a second, non-circular predetermined cross-sectional shape also has a plurality of threads formed thereon to receive a lock nut and said first bracket portion additionally includes a rear surface against which the lock nut may be tightened to clamp the electrical socket flange portion to said front surface of said first bracket portion.

4. A structure as set forth in claim 1, wherein said first opening is formed to provide a clearance on the order of a few thousandths of an inch between said first opening and the electrical socket flange portion.

5. A structure for mounting an electrical socket to receive the plug-in electrical connector of an electrical cable and for preventing relative movement of the electrical socket during use, the electrical socket including a flange portion, a shank portion with at least one segment having a predetermined non-circular cross-sectional shape and an electrically-conductive receptacle embedded in the shank portion to provide an electrical contact surface for the plug-in electrical connector, said structure comprising:

(a) a panel means for securing the electrical socket against lateral movement in a first plane, said panel means having a first opening formed therein to receive the electrical socket flange portion with minimal clearance, said panel means also having an edge defined by said first opening to support the flange portion of the electrical socket such that any lateral forces in said first plane tending to move the electrical socket laterally bear instead against said edge in a manner which prevents lateral movement of the electrical socket, and (b) a bracket means attached to the rear surface of said panel means for securing the electrical socket against both rotation and lateral movement in a second plane parallel to said first plane, said bracket means including a first bracket portion with a second opening formed therein to receive the electrical socket shank portion when said first opening receives the electrical socket flange portion, said second opening having a contour corresponding to the predetermined non-circular cross-sectional shape of the electrical socket shank portion segment, said bracket means also including a second bracket portion connecting said first bracket portion to the rear surface of said panel means such that said first bracket portion is spaced a predetermined distance from the rear surface of said panel means.

* * * * *